United States Patent [19]

Wirz

[11] 4,152,564

[45] May 1, 1979

[54] ACTUATING DEVICE FOR A BATTERY OPERATED MODULE

[76] Inventor: Carl A. Wirz, Weinbergstr. 26, 6300 Zug, Switzerland

[21] Appl. No.: 762,489

[22] Filed: Jan. 26, 1977

[30] Foreign Application Priority Data

Mar. 17, 1976 [CH] Switzerland ..... 3304/76

[51] Int. Cl.[2] ..... H01H 3/12; H01H 1/14

[52] U.S. Cl. ..... 200/159 R; 200/239

[58] Field of Search ..... 200/239, 340, 153 SC, 200/159 R, 165, 16 R, 16 B, 52 R; 58/85.5, 90 R, 23 R, 33, 34

[56] References Cited

U.S. PATENT DOCUMENTS

| | | | |
|---|---|---|---|
| 3,141,945 | 7/1964 | Juggins | 200/159 R |
| 3,974,351 | 8/1976 | Solov et al. | 200/159 R |
| 4,007,347 | 2/1977 | Haber | 200/159 R |
| 4,031,348 | 6/1977 | Eberhardt | 200/159 R |

*Primary Examiner*—William Price
*Assistant Examiner*—Steven M. Pollard
*Attorney, Agent, or Firm*—Imirie, Smiley & Guay

[57] ABSTRACT

An actuating device for a battery operated electronic module accommodated in a metallic or plastic case and comprising one push-button associated with a return-spring, said push-button including one resilient section with a collar which, cooperating with an opening in an element acting as a support for the return-spring limits the travel of the push-button in one direction, the travel length being determined by a face of the push-button abuting against a terminal of said electronic module.

The actuating device will ensure a sufficient sealing (water-tight protection) of the case and will be very simple, of low cost and with machining tolerances as large as possible.

8 Claims, 2 Drawing Figures

ACTUATING DEVICE FOR A BATTERY OPERATED MODULE

FIELD OF THE INVENTION

The present invention relates to an actuating device for a battery operated module accommodated in a case, comprising at least one push-button associated with a return spring.

SUMMARY OF THE INVENTION

An object of the invention is to realize an actuating device which provides, by means of a push-button, a reliable electrical contact between one of the poles of a battery feeding the module and a terminal mounted on the surface of the module.

Another object of the invention is to ensure a sufficient sealing (watertight protection) of the case.

A further object of the invention is to provide a low cost actuating device comprising a very simple push-button with machining tolerances as large as possible; furthermore the drillings in the case for the push-button and the assembly of the device must be easily accomplished.

Still another object of the invention is to provide an actuating device which can be mounted on a metallic or a plastic case.

To achieve the above, a device is provided wherein the aforesaid push-button comprises at least one resilient section with a collar which, cooperating with an opening made in an element acting as a support for aforesaid return-spring, limits the travel of the push-button in one direction, the travel length being determined by a face of the push-button abuting against a terminal of said module, thus closing a circuit actuating a particular function of the electronic module.

Hereafter two embodiments of the invention are described with reference to FIGS. 1 and 2.

DETAILED DESCRIPTION

Figure 1:
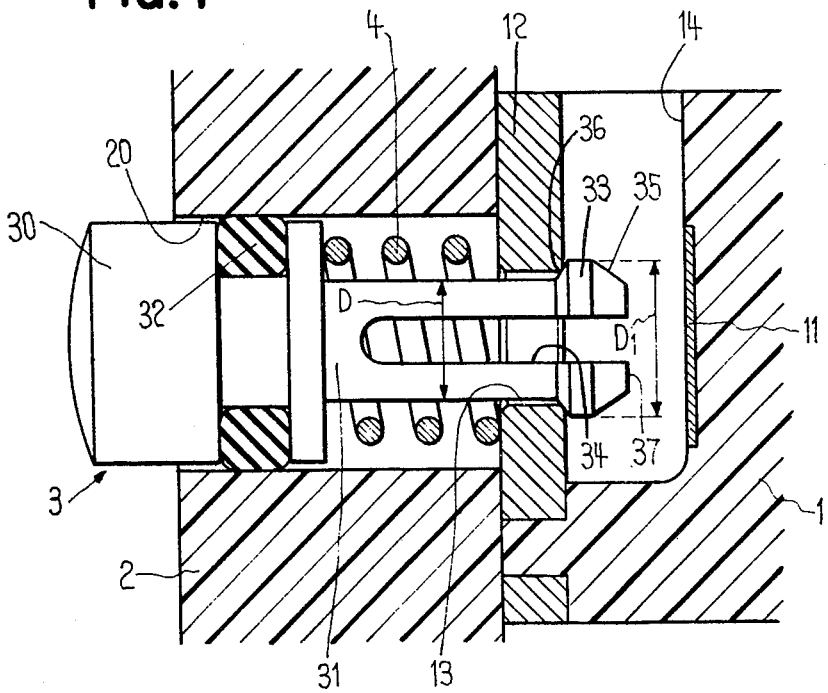
FIG. 1 is a partial cross-sectional view of one embodiment of the actuating device.

FIG. 1 shows an actuating device for an electronic module according to the invention. The electronic module 1 is accommodated in a metallic or plastic case 2 comprising one push-button 3 associated with a return-spring 4. The push-button 3 comprises a cylindrical element 30 with a groove for the circular gasket 32 and one piece 31 pressed into the element 30. Piece 31 has a resilient section consisting of a cylindrical portion of diameter D and a collar 33 of diameter D1>D, the collar and the cylindrical portion being split by a diametrical slit 34. The collar 33 has a chamfered portion 36 and a conical portion 35 near its face 37. The face 37 may be gold plated in order to improve the quality of the electrical contact.

The length and the width of the slit 34 are the parameters determining the flexibility of the resilient section of the push-button.

A ring 12 is moulded into the material at the surface of the electronic module 1 which also supports terminals 11 accommodated whithin a slot 14. The ring 12 has a drilling 13 disposed coaxially with the push-button and having a diameter between D and D1, such as to allow, due to the resilient section, the introduction of the collar 33 by exerting a appropriate pressure on the push-button and that when said push-button has been inserted through the drilling 13, it cannot be pulled out under the action of the return-spring 4. The drilling 13 has chamfered end portions in order to facilitate the introduction of the cone 35 and to provide a larger base for the chamfer 36.

The assembly of the device is very simple: The module 1 is introduced into the case 2 in the proper angular position, then the return-spring 4 is placed into the smooth drilling 20 of the case 2 and finally the push-button is inserted and locked in the ring 12 (chamfer 36 abutes against ring 12). In the embodiment of FIG. 1, the module 1 is positioned angularly and vertically by the push-button; the ring 12 is a support for the return-spring 4. Another advantage is that the drilling 20 may be smooth.

Figure 2:
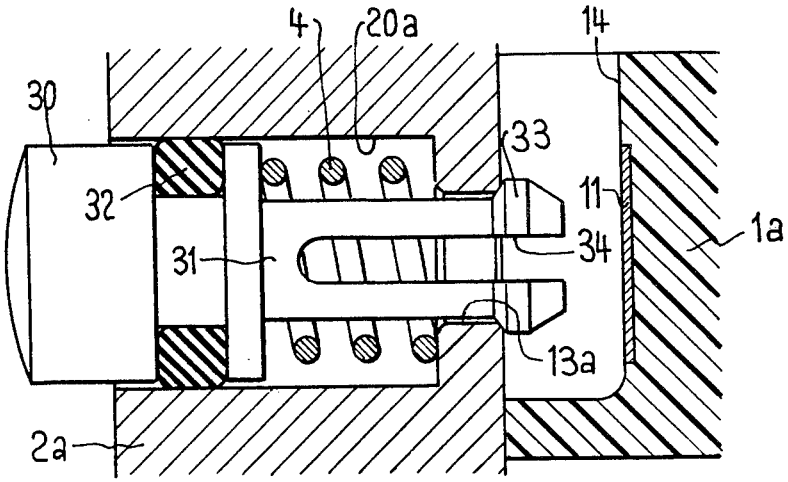
FIG. 2 is a partial cross-sectional view of another embodiment of the actuating device.

FIG. 2 shows another embodiment of the actuating device, without the ring 12 of FIG. 1. In this execution, the electronic module **1*a* is accommodated in a metallic case 2*a* with a flat-bottom drilling 20*a*, said flat bottom having a drilling 13*a* of a smaller diameter. All other elements are the same as shown in FIG. 1 and there designation is therefore the same in FIG. 2. The return-spring 4 is supported by the flat bottom of the drilling 20*a* and the drilling 13*a* allows the introduction of the collar 33, which still indexes the angular position of the module 1*a*. It is also feasible to provide a smooth drilling 20*a* wherein the flat bottom is formed by a ring having a corresponding outer diameter and an opening of the same diameter as that of the drilling 13*a*, this ring being pressed into the inner end of drilling 20*a***.

The return-spring 4 can be mounted on the push-button 3 during assembly of the device if its inner diameter is smaller than D1.

Furthermore, the push-button can be made in one piece and can accommodate more than one sealing gasket.

The actuating device is intended to actuate certain functions, for instance the display of miniature electronic apparatus like thermometers, depth indicators or watches.

For example, in order to correct the time of an electronic watch, one of the push-buttons is depressed; the face 37, abuting at the end of the travel against one of the terminals 11, will close through the return-spring 4 abuting against ring 12, a circuit actuating the desired function. Usually, each function is separately actuated by a push-button.

I claim:

1. An actuating device for a battery operated electronic module having a terminal electrically connected thereto and accommodated inside a case, the case having a bore extending therethrough, said actuating device comprising:

a stationary element defining a constricted inner opening of the bore, the wall of said stationary element defining said opening being chamfered on both the proximal and distal sides thereof, the terminal being mounted in alignment with the opening and spaced from the distal end thereof;

a return-spring supported by the stationary element; and a one-piece push-button in the bore extending through the opening and in engagement with said return-spring, said push-button including an end face at the distal end thereof which engages the terminal, thus limiting the travel of said push-button in one direction, when said push-button is depressed against the resilient action of said return-spring, and thus closing a circuit actuating a particular function of the electronic module, said push-button also including at least one resilient section with an integral, annular collar having chamfered portions on each end thereof, the distal chamfered collar portion, the proximal chamfer of the opening wall and the resiliency of said resilient section permitting said push-button to be assembled into the bore of the case and through said inner opening, and the proximal chamfered collar portion resiliently engaging the distal chamfer of the opening inside wall of the stationary element when said push-button is not depressed, thus limiting the travel of said push-button in the other direction, and the proximal chamfered collar portion, the distal chamfer of the opening wall and the resiliency of said resilient section permitting said push-button to be disassembled from the case.

2. Use of the device according to claim 1 for an electronic watch.

3. Actuating device according to claim 1, wherein said resilient section consists of said collar and a cylindrical portion of said push-button, said collar and portion being split by a diametrical slit.

4. Actuating device according to claim 1, wherein said opening is made in the case at the flat bottom of a drilling, said push-button slidably extending through said opening.

5. Actuating device according to claim 1, wherein said opening is made in an element rigidly connected to said electronic module.

6. An actuating device according to claim 1, wherein said collar is joined to a cylindrical portion of said resilient part through a chamfered portion which permits said push-button to be drawn out of said stationary element.

7. An actuating device according to claim 1, wherein said stationary element is chamfered in order to facilitate the insertion and the extraction of said collar through said opening in said stationary element.

8. An actuating device according to claim 1, wherein said push-button, said return-spring and said stationary element are metallic parts which are inserted in a control circuit for a particular function of said module.

* * * * *